US005758483A

United States Patent [19]

Phillips et al.

[11] Patent Number: 5,758,483

[45] Date of Patent: Jun. 2, 1998

[54] TWISTING APPARATUS

[75] Inventors: David Graham Phillips; Keith Alan Thomas, both of Belmont, Australia

[73] Assignee: Commonwealth Scientific & Industrial Research Organisation, Campbell, Australia

[21] Appl. No.: 617,827

[22] PCT Filed: Sep. 13, 1994

[86] PCT No.: PCT/AU94/00544

§ 371 Date: May 13, 1996

§ 102(e) Date: May 13, 1996

[87] PCT Pub. No.: WO95/08012

PCT Pub. Date: Mar. 23, 1995

[30] Foreign Application Priority Data

Sep. 17, 1993 [AU] Australia ..... PM1272

[51] Int. Cl.[6] ..... D01H 13/04

[52] U.S. Cl. ..... 57/310; 28/240; 28/245; 57/60; 57/66; 57/287; 57/288

[58] Field of Search ..... 57/287, 288, 308, 57/310, 58.7, 60, 65, 66, 66.5; 28/240, 245, 246, 249

[56] References Cited

U.S. PATENT DOCUMENTS

| | | | |
|---|---|---|---|
| 3,373,549 | 3/1968 | Shaw | 57/34 |
| 3,439,394 | 4/1969 | Gray et al. | 28/246 |
| 3,481,012 | 12/1969 | Saxon | 28/246 |
| 3,503,100 | 3/1970 | Glynn et al. | 28/246 |
| 3,807,156 | 4/1974 | Gre | 57/58.52 |
| 3,808,787 | 5/1974 | Vogelsberg | 57/34 AT |
| 4,112,668 | 9/1978 | Spiller | 57/157 |
| 4,961,307 | 10/1990 | Cook | 57/310 |
| 5,092,117 | 3/1992 | Paivinen et al. | 57/293 |
| 5,303,537 | 4/1994 | Kot et al. | 57/38.36 |
| 5,365,729 | 11/1994 | Phillips et al. | 28/246 |
| 5,477,669 | 12/1995 | Phillips et al. | 28/240 |

FOREIGN PATENT DOCUMENTS

| | | |
|---|---|---|
| 0048130 | 3/1982 | European Pat. Off. . |
| 302085 | 6/1916 | Germany . |
| 1932062 | 1/1970 | Germany . |
| 8700877 | 2/1987 | WIPO . |
| 9208841 | 5/1992 | WIPO . |

*Primary Examiner*—William Stryjewski

*Attorney, Agent, or Firm*—Sughrue, Mion, Zinn, Macpeak & Seas, PLLC

[57] ABSTRACT

Apparatus for twisting a travelling strand includes a rotary structure rotatable about a rotational axis X—X and a series of pulleys mounted on the structure in an array disposed about the rotational axis X—X with each pulley in the series mounted on the structure for rotation about an individual axis of pulley rotation which is generally parallel to the axis X—X and moves around that axis on rotation of the structure. An input strand guide pulley guides an input strand to be twisted onto a path in which it will successively engage the pulleys and a strand exit guide pulley guides the strand from that path into an exit path along the axis X—X. The rotary structure is driven through a drive shaft and the pulleys are rotated by gearing.

10 Claims, 6 Drawing Sheets

TWISTING APPARATUS

TECHNICAL FIELD

This invention relates to apparatus for twisting travelling strands. As used herein the term "strand" extends to any fibre or filament or any elongate coherent assembly of fibres or filaments.

The insertion of twist into an assembly of staple textile fibres, such as a sliver or roving, is a well-known textile processing step which is used for example to impart strength to an assembly of fibres, as in yarn manufacture. It may also be used to provide a degree of control over a fibre assembly during operations prior to spinning, as for example in a drafting operation. The insertion of false twist as opposed to real twist is also well-known and is used in a variety of textile processes.

The applicant's International Patent Application No PCT/AU90/00349 (International Publication No WO 91/02835) discloses a method and apparatus for stretching the fibres in an assembly of staple fibres, such as a sliver or roving, by which false twist is imparted to the assembly to provide grip between the fibres to ensure that they are stretched rather than drafted. As used herein, the term "drafted" refers to elongation of a fibre assembly by longitudinal slippage between the fibres of the assembly. The stretching occurs between at least two arrays of pulleys which are mounted for rotation between two spaced pair of nip rollers with the arrays of pulleys extending along a direction of travel of the fibre assembly through the apparatus.

It has been found that apparatus of the kind illustrated in International Patent Application No PCT/AU90/00349 is prone to a number of problems, including excessive wear of bevel gears used in the pulley drive system, damage to bearings and gears which are exposed to a corrosive environment, difficulty in dynamically balancing the rotating pulley carriages and maintenance difficulties due to poor access of parts within the rotating assemblies. The present invention provides an alternative kind of twisting apparatus which enables these problems to be greatly alleviated.

Although the apparatus of the present invention has been developed to overcome the above stated problems associated with previous apparatus for stretching staple fibres, it will be evident from the ensuing description that the apparatus according to the invention can be used for twisting a travelling strand for any purpose and it is to be understood that the invention extends to an apparatus for twisting a travelling strand for any purpose.

DISCLOSURE OF THE INVENTION

According to the invention there is provided apparatus for twisting a travelling strand, comprising:

a rotary structure rotatable about a rotational axis;

a plurality of pulleys mounted on the rotary structure in an array disposed about said rotational axis with each pulley in the array rotatably mounted on the structure for rotation about an individual axis of pulley rotation which is generally parallel to said rotational axis and moves around said rotation axis on rotation of the rotary structure;

input strand guide means to guide an input strand to be twisted into a path in which it will successively engage the pulleys of the array;

strand exit guide means to guide the strand from said path into an exit path from the apparatus; and drive means operable to rotate the rotary structure about said rotational axis and also to rotate at least one of the pulleys of said array about its respective individual axis whereby to drive the strand forwardly to said exit path.

Preferably, the strand input guide means is effective to guide the travelling strand from an input path extending along said rotational axis into the path in which it will successively engage the pulleys of said array.

The strand input guide means may comprise an input guide pulley mounted on said rotary structure to engage the travelling strand at a location along said rotary axis and to guide the strand radially outwardly of that axis toward the first of the pulleys of said array to be engaged by the strand. The input guide pulley may be freely rotatable about an axis transverse to the rotational axis of the rotary structure.

Preferably, the strand exit guide means is effective to guide the travelling strand from the path in which it successively engages the pulleys of said array into an exit path extending along the rotational axis of the rotary structure. The strand exit guide means may comprise an exit guide pulley mounted on the rotary structure to engage the travelling strand after its engagement with the pulleys of said array and to change its direction from a direction extending radially inwardly of the rotational axis of the rotary structure into said exit path.

Preferably, the drive means is operable to rotate all of the pulleys of said array about their respective individual axes at the same peripheral speed whereby positively to drive the traveling strand through the apparatus.

The invention also extends to apparatus for stretching a travelling assembly of staple fibres, comprising a twist block through which to pass a travelling assembly of staple fibres to be stretched and a pair of twist devices through which successively to pass the travelling assembly of staple fibres downstream from the twist block, wherein each of the twisting devices comprises an apparatus constructed in accordance with any one of the preceding claims and wherein the drive means of the twist devices are operable to drive the driven pulley or pulleys of the downstream twisting device at a higher peripheral speed than the driven pulley or pulleys of the upstream twisting device thereby to stretch the travelling assembly of fibres as it passes between the pair of twisting devices.

BRIEF DESCRIPTION OF THE DRAWINGS

In order that the invention may be more fully explained its application to apparatus for stretching staple fibres will be described with reference to the accompanying drawings in which.

DETAILED DESCRIPTION OF THE PREFERRED EMBODIMENTS

Figure 1:
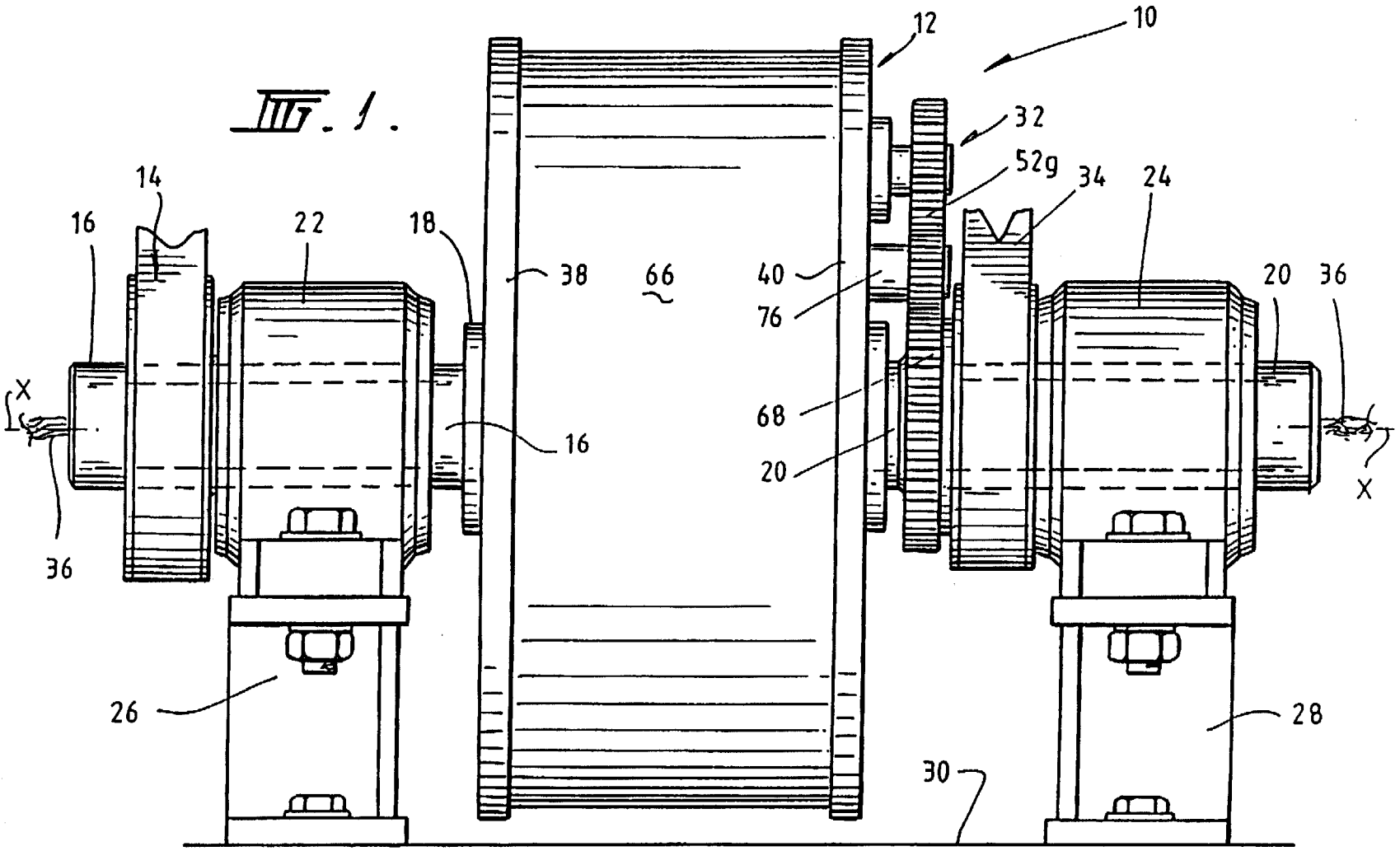
FIG. 1 is a side-elevation of a twisting device constructed in accordance with the invention.

FIGS. 1 to 4 illustrate a twisting device denoted generally as 10 which is constructed in accordance with the present invention.

Twisting device 10 comprises a rotary structure in the form of a housing 12 which is rotatable about a longitudinal axis X—X by a belt driven pulley 14. The pulley 14 is fixed to hollow shaft 16 which extends from the housing 12. Shaft 16 is fixed to housing 12 by an annular flange 18 which is welded to the shaft (see FIG. 2). A second hollow shaft 20 is similarly fixed to and extends from the opposite side of housing 12. Shafts 16 and 20 are mounted for rotation in bearings 22 and 24, which are supported by brackets 26 and 28 extending from and fixed to a frame or bed 30.

Housing 12 contains a series of pulleys (to be described below) which are driven by gearing 32. Gearing 32 is driven by a belt and pulley drive 34, the pulley of which is mounted for rotation about shaft 20 via a bearing (not illustrated).

In operation, housing 12 is rotated by drive pulley 14 and a series of pulleys within the housing are independently driven via the belt and pulley drive 34 and gearing 32 to drive a strand 36 through the device via hollow shafts 20 and 16. The rotation of housing 12 inserts twist into the travelling strand 36, which may be a sliver of staple textile fibres.

Figure 2:
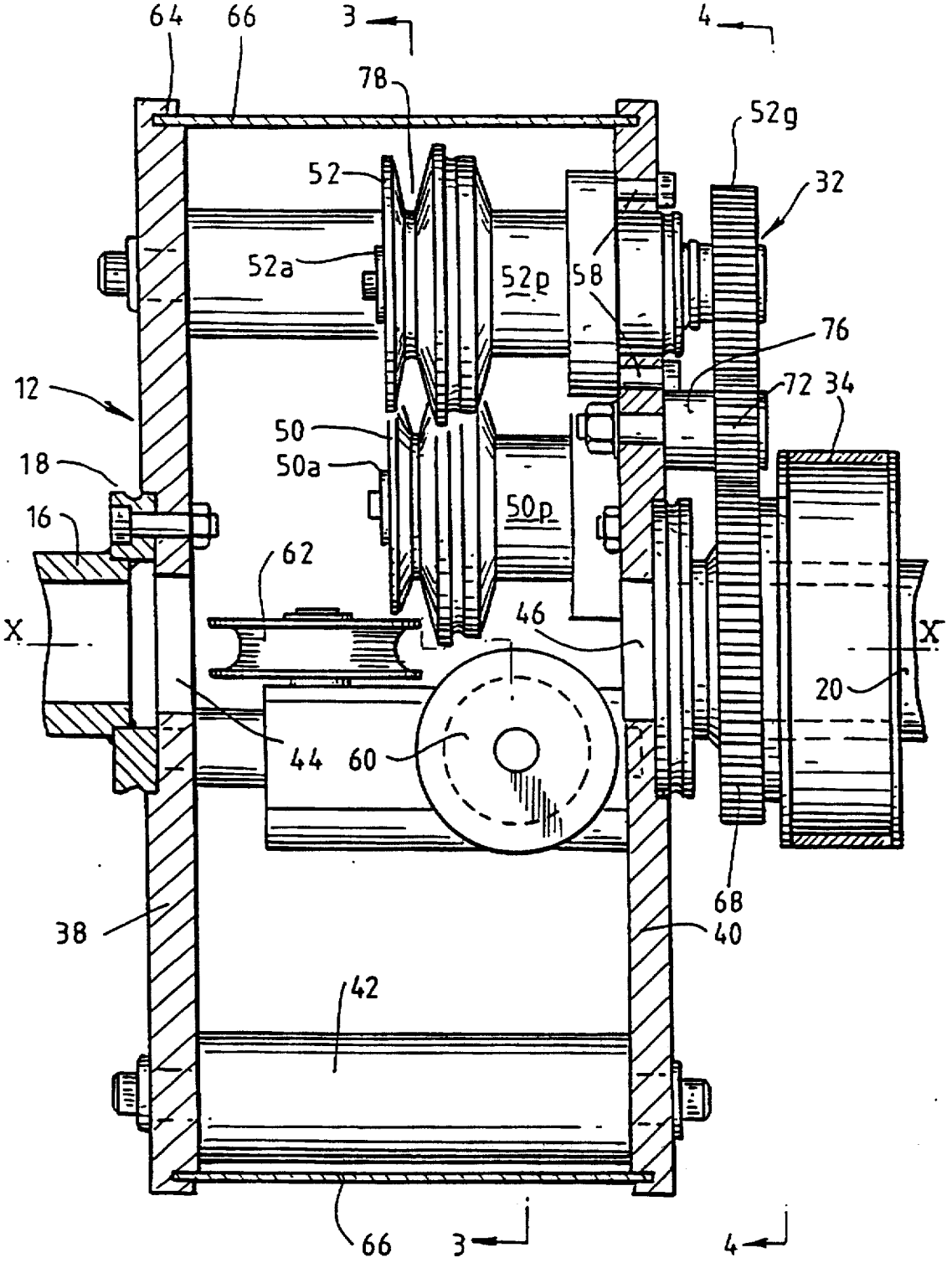
FIG. 2 is a vertical cross-section through a central part of the twisting device illustrated in FIG. 1.

As most clearly seen in FIG. 2, housing 12 comprises circular end plates or walls 38 and 40 which are is attached together in spaced relation by a number of, for example four, bolt and spacer assemblies 42. Central apertures 44 and 46 in walls 38 and 40 respectively, communicate with the hollow centres of shafts 16 and 20 for passage of a fibre assembly.

Figure 3:
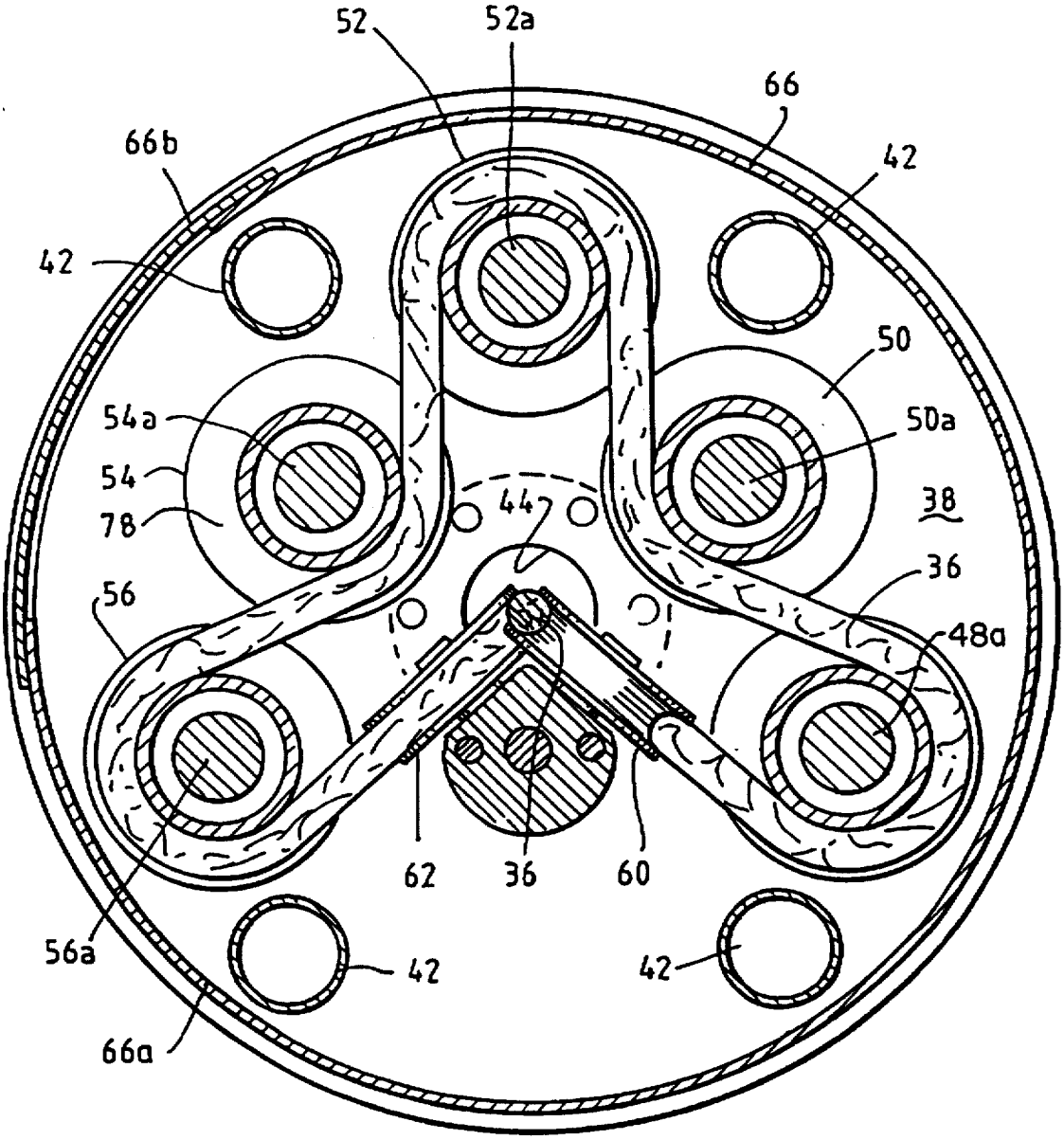
FIG. 3 is view generally on the line 3—3 in FIG. 2.

A series of pulleys 48, 50, 52, 54 and 56 are mounted on an end wall 40 in an array disposed about the rotational axis X—X of the housing 12. All five pulleys are shown in FIG. 3 but FIG. 2 omits some of them for the sake of clarity. Each pulley is attached to one end of an associated axle 48*a*, 50*a*, 52*a*, 54*a* and 56*a*, and the other ends of the axles have associated gears 48*g*, 50*g*, 52*g*, 54*g* and 56*g* attached thereto for driving the pulleys. Axles 48*a* to 56*a* are mounted by bearings supported in associated pedestals 48*p*, 50*p*, 52*p*, 54*p* and 56*p*, which are attached to end plate 40, for example by bolts 58. Thus each of the pulleys 48, 50, 52, 54 and 56 is mounted on the housing 12 for rotation about an individual axis of pulley rotation which is generally parallel to the rotational axis X—X of the housing and which will move around the axis X—X on rotation of the housing.

Also mounted within housing 12 is a free running input guide pulley 60 and free running output guide pulley 62. As shown in FIG. 3, guide pulley 60 diverts inward travelling strand 36 to driven pulley 48 and guide pulley 62 diverts the strand travelling from driven pulley 56 to the twist axis to travel outwards of the housing through aperture 44 and hollow shaft 16. More specifically, the input guide pulley 60 is effective to guide the strand 36 radially outwardly from an input path extending along the rotational axis X—X so as to engage the pulley 48 and the output guide pulley 62 is effective to receive the strand from the driven pulley 56 and guide it into an exit path extending along the rotational axis X—X as an extension of the strand input path.

End plates 38 and 40 of housing 12 each include an inwardly facing groove 64 near its periphery within which is seated a sectioned cover 66. Thus housing 12 is formed by the end plates 38 and 40 and surrounding cylindrical cover 66. As shown in FIG. 3, cover 66 comprises sections 66*a* and 66*b* which are relatively slideable within grooves 64. Access to the interior of the housing is facilitated by forming an aperture by sliding section 66*b* over section 66*a*. Although section 66*b* is illustrated as being shorter than section 66*a*, they may be of substantially the same length, that is they may each extend for about half the circumference of housing 12.

In an alternative arrangement (not illustrated) end plates 38 and 40 could each include two closely spaced parallel inwardly facing grooves (similar to grooves 64) for slidingly holding a number of cover sections, wherein some cover sections are spaced apart within one groove and other cover sections are spaced apart within the other groove. This arrangement would allow even easier access than the illustrated sliding sections of 66*a* and 66*b*. The cover sections may include handles on their outer surface to facilitate their handling for sliding within the grooves.

Figure 4:
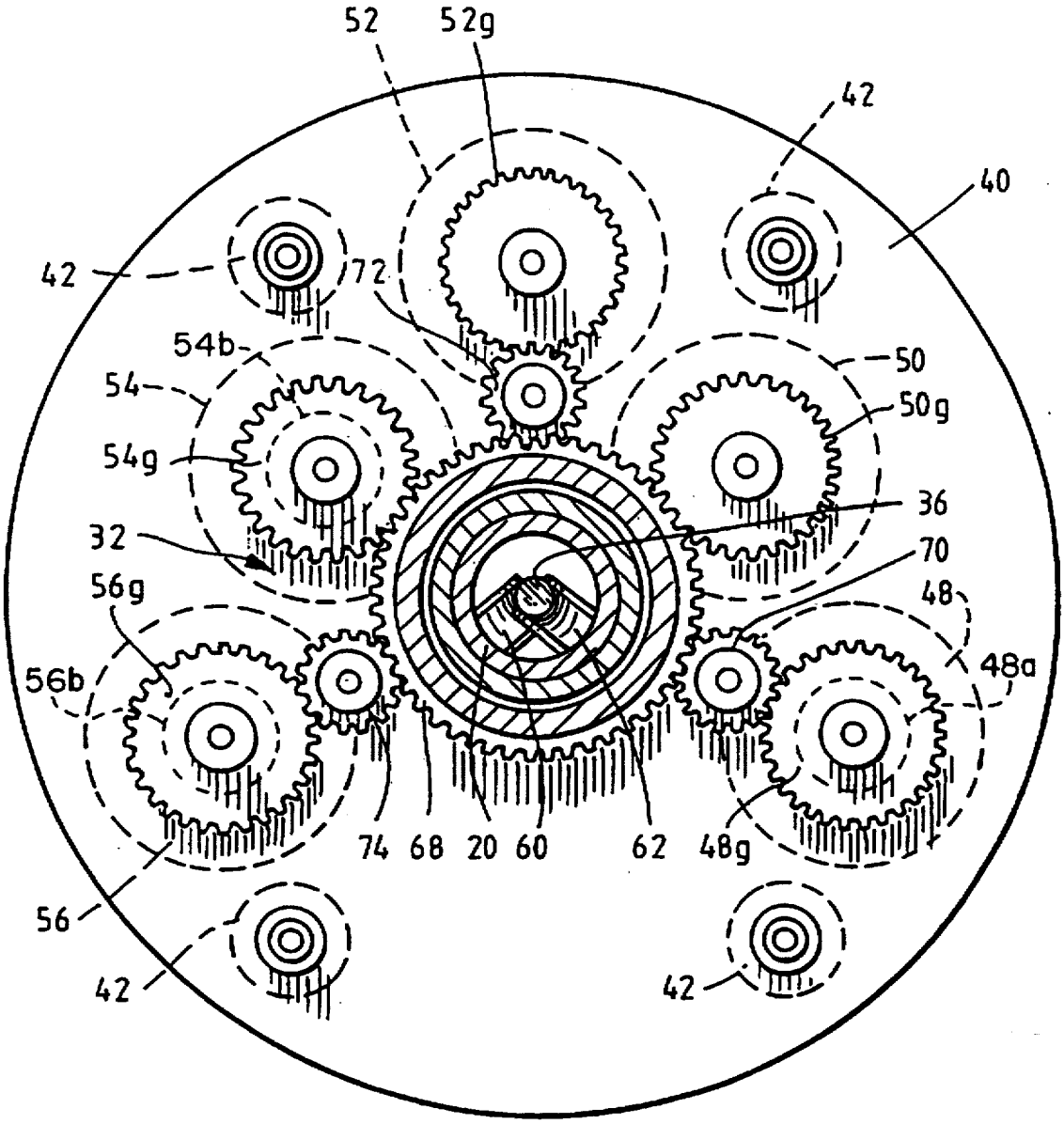
FIG. 4 is a cross-section on the line 4—4 in FIG. 2.

FIG. 4 shows the gearing 32 for driving the pulleys 48 to 56. Belt drive 34 drives a sun gear 68 which engages gears 50*g* and 54*g* for pulleys 50 and 54. Small gears 70, 72 and 74 are interposed between sun gear 68 and pulley gears 48*g*, 52*g* and 56*g* to ensure the correct direction of rotation for the associated pulleys 48, 52 and 56. Small gears 70, 72 and 74 are mounted by bearings on associated shafts (eg 76 in FIG. 2) bolted to the end plate 40. Thus, whilst gears 48*g* to 56*g* and 70, 72 and 74 are rotating via their being mounted on rotating plate 40 of housing 12, they are simultaneously driven (so as to drive a sliver by the pulleys through the twisting device 10) by sun gear 68 (which is rotatably mounted on shaft 20) which in turn is driven by belt and pulley drive 34.

Strand 36 is diverted from its input path along rotational axis X—X by input guide pulley 60 and is driven by pulleys 48-50-52-54-56 through the twisting device. From driven pulley 56, the sliver is diverted by exit guide pulley 62 to exit the housing in an exit path along the rotational axis X—X. In each of pulleys 48 to 56 a V shaped groove 78 having a rounded bottom (best seen in FIG. 2) is formed in its outer facing periphery. It is important that sufficient drive pulleys be provided and their driving groove profile be such that the strand to be twisted can be driven through the twisting device without slipping. The illustrated embodiment is suitable for driving and twisting a sliver of textile fibres of 80–100 kTex at a through speed of 24 m/s at a maximum rotational speed of about 750 rpm. In this embodiment, housing 12 of the device is approximately 42 cms in diameter and 22 cms wide. Pulleys 48 to 56 are approximately 10 cms in diameter and have a diameter of approximately 5 ½ cms measured from the base of the driving groove. Components within housing 12 may be made of stainless steel or other material which is not adversely affected by a corrosive atmosphere which may exist within the housing.

Figure 5:
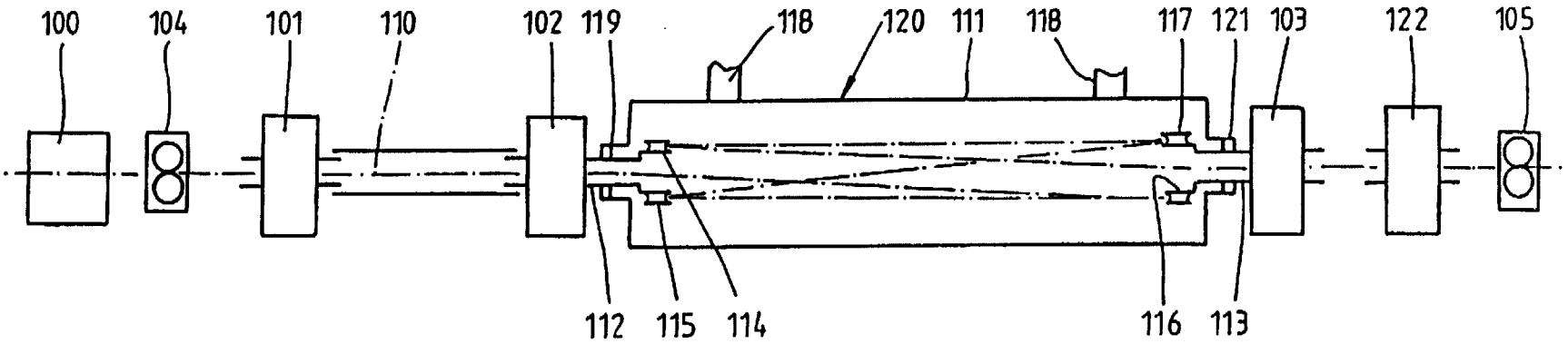
FIG. 5 illustrates an apparatus for stretching a travelling assembly of staple fibres which incorporates a pair of twisting devices constructed in accordance with the invention.

FIGS. 5 to and 6 illustrate an apparatus for stretching and setting the fibres in an assembly of textile fibres (eg a sliver) using twisting devices of the invention. This apparatus may be used in the method which is described in the applicant's abovementioned International Patent Application No PCT/AU90/00349. The apparatus comprises a strand treatment bath 100 and four twisting devices 101, 102, 103 and 122 spaced apart along a common twist axis between a pair of upstream supply rollers 104 and a pair of downstream delivery rollers 105. Each of the twisting devices 101, 102, 103 and 122 may be of the construction illustrated in FIGS. 1 to 4.

Figure 6:
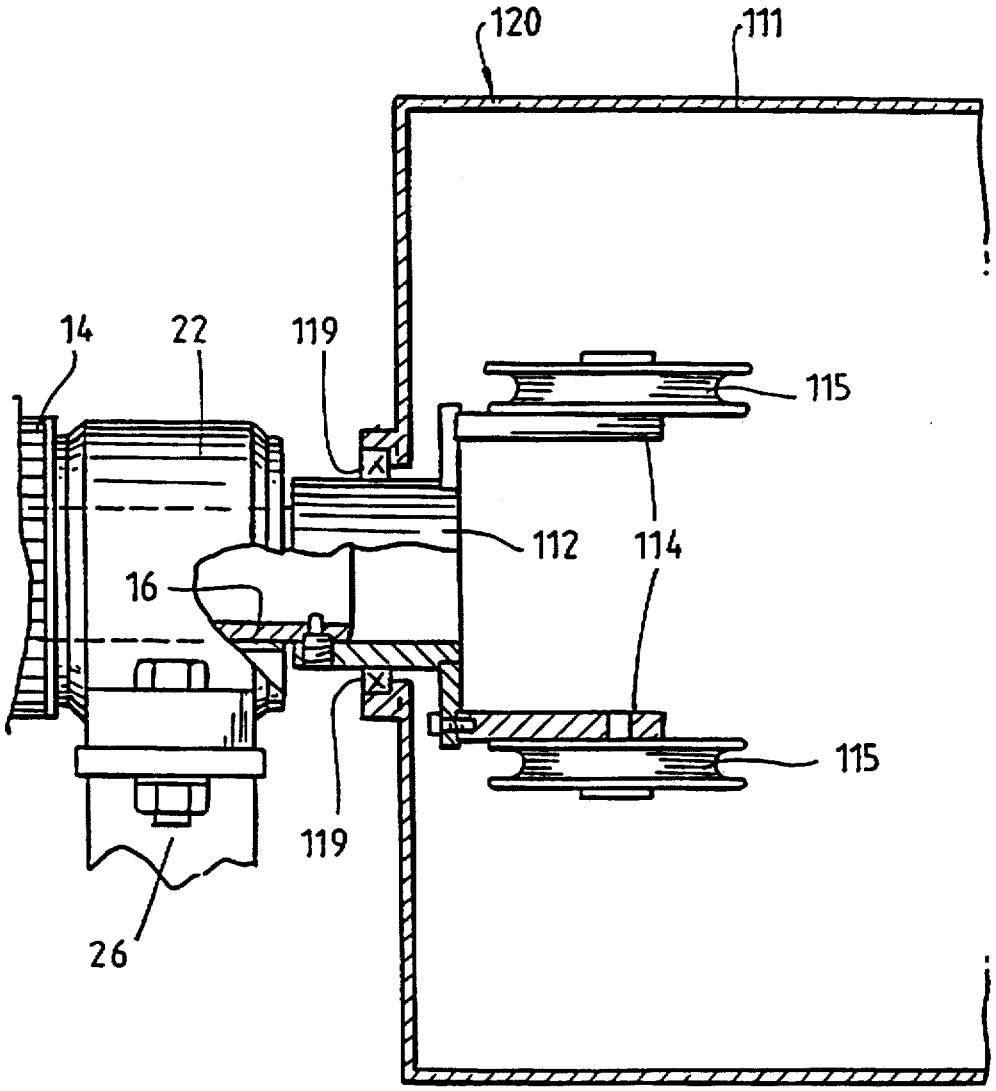
FIG. 6 illustrates constructional details of the apparatus shown in FIG. 5.

In operation of the apparatus illustrated in FIGS. 5 to 6, an assembly 110 of fibres to be stretched is first wetted in bath 100 with a suitable plasticising agent in the manner which is fully described in the applicant's International Patent Application No PCT/AU90/00349. The plasticised assembly then passes successively through the twisting devices 101, 102, 103 and 122. The nip between rollers 104 constitutes a twist block so that false twist is inserted into travelling sliver 110 by the rotation devices 101, 102, 103 and 122. The zone between twisting devices 101 and 102 is for stretching the fibres and the zone between devices 102 and 103 is for setting the stretch in the fibres. The zone between devices 103 and 122 is to maintain tension downstream of device 103 so th sliver is driven through the twisting device without slipping on the pulleys. The false twist inserted by devices 101 and 102 must be such as to provide sufficient grip between the fibres to ensure they are stretched rather than drafted. Twisting device 102 may be rotated at a higher speed than device 101. The fibres are stretched in the zone between devices 101 and 102 by driving the pulleys within device 102 at a higher speed than the pulleys in device 101.

In the setting zone between the twisting devices 102 and 103, the apparatus incorporates a strand accumulation and steam setting device denoted generally as 120. This device comprises a stationary steam cabinet 111 which may be the shape of an elongate rectangular box. A pair of tubular shafts 112, 113 project through end walls of the steam cabinet 111 and are coupled respectively to the rotary drive shafts of the twisting devices 102, 103 so that shaft 112 rotates with the rotary housing of twisting device 102 and shaft 113 rotates with the rotary housing of the device 103. The inner end of shaft 112 carries a pulley mounting bracket 114 on which there is mounted a pair of freely rotatable accumulator pulleys 115 which are spaced apart one to either side of the central axis of rotation. The inner end of shaft 113 carries a pulley mounting bracket 116 on which is mounted a pair of accumulator pulleys 117 disposed in a similar fashion to the accumulator pulleys 115. The travelling sliver 110 travels around the accumulator pulleys 115, 117 so as to pass back and forth within the steam cabinet 111 in a succession of mutually oppositely directed passes so as to extend the residence time of the sliver within the steam cabinet.

Cabinet 111 is provided with steam inlets 118 whereby steam is admitted to the chamber to subject the accumulated sliver within the cabinet to steam treatment in order to set the false twist imparted by rotation of the three twisting devices 101, 102, 103 and 122. Rotary gland seals 119, 121 may be provided between the rotating tubular shafts 112, 113 and the stationary steam cabinet 111.

With the provision of the accumulation pulleys within the steam cabinet 111 it is essential that the rotational speeds of the shafts 112, 113 be the same. This can be achieved by means of an electronic speed control linking the drives of the twisting devices 102 and 103 so as to rotate the housings of the two devices at identical rotational speed. It would alternatively be possible to provide a direct mechanical coupling between the tubular shafts 112, 113. Twisting device 122 ensures that the assembly of fibres 110 is securely engaged in the twisting device 103 to maximise tension control. It would also be possible to extend the steam cabinet to envelop the twisting devices 101 and 102 so as to provide steam treatment in the stretching zone between those devices.

The illustrated twisting devices can be much more readily balanced than the prior art devices in which the twisting and stretching pulleys were spread out along a central twisting axis. The pulleys in the illustrated devices are arranged in a generally planar array around the central twist axis and can be spaced circumferentially of the device so as to provide complete dynamic balance. This arrangement also allows a simpler drive mechanism through a planetary gear system which can moreover be isolated from the enclosures within which the travelling strand is to be twisted and otherwise treated. Any corrosive environments associated with treatment of the travelling strand can be contained so as to exclude them having any deleterious effect on the drive system.

The invention also facilitates the construction of compact twisting devices which can be mounted at any desired spacing. It has been found that in the stretching of staple fibres improved stretching can be achieved by increasing the spacing between the twisting devices to ensure an adequate time span for imparting the stretch. It has been found that such "slow stretching" of wool fibres imparts beneficial properties to the stretched fibres in that the wet stiffness value of the parent fibres is maintained whilst the dry and wet tenacity of the fibres is increased.

We claim:

1. Apparatus for stretching a travelling assembly of staple fibres, comprising:

a pair of spaced apart twist blocks through which to pass a travelling assembly of staple fibres to be stretched;

a first twisting device located between said twist blocks and comprising a first rotary structure rotatable about a first rotational axis, a first plurality of pulleys mounted on the first rotary structure in an array disposed about the first rotational axis with each pulley in the first array rotatably mounted on the first rotary structure for rotation about an individual axis of pulley rotation which is generally parallel to said first rotational axis and moves around said rotational axis on rotation of the first rotary structure, a first input guide means to guide the travelling assembly into a path in which it will successively engage the pulleys of said first array, and first exit guide means to guide said travelling assembly from said path into an exit path from the first twisting device;

a second twisting device located between the twist blocks to receive the travelling assembly after it exits the first twisting device and comprising a second rotary structure rotatable about a second rotational axis, a second plurality of pulleys mounted on the second rotary structure in an array disposed about the second rotational axis with each pulley in the second array rotatably mounted on the second rotary structure for rotation about an individual axis of pulley rotation which is generally parallel to said second rotational axis and moves around said second rotational axis on rotation of the second rotary structure, second input guide means to guide the travelling assembly entering the second twisting device into a path in which it will successively engage the pulleys of said second array, and second exit guide means to guide the travelling assembly from said path into an exit path from the second twisting device;

first drive means operable to rotate said first rotary structure about the first rotational axis and also to rotate the pulleys of said first array about their respective pulley axes; and second drive means operable to rotate said first second rotary structure about said second rotational axis and also to rotate the pulleys of the second array about their respective pulley axes at greater peripheral speed than the pulleys of the first array thereby to stretch the travelling assembly of fibres as it passe between the first and second twisting devices.

2. Apparatus as claimed in claim 1, wherein the second drive means is operable to drive the second rotational structure at a higher speed of rotation than the speed of rotation of the first rotary structure on operation of the first drive means.

3. Apparatus as claimed in claim 1, wherein the pulleys of said first array are spaced about the first rotational axis of the first rotary structure at successively greater and lesser distances from the first rotational axis and the first drive means is operable to rotate successive pulleys in the first array in mutually opposite directions of rotation.

4. Apparatus as claimed in claim 1, wherein the pulleys of said second array are spaced about the second rotational axis of the second rotary structure at successively greater and lesser distances from the second axis of rotation and the second drive means is operable to rotate successive pulleys in the second array in mutually opposite directions of rotation.

5. Apparatus as claimed in claim 1 further comprising a third twisting device located between said twist blocks to receive the travelling assembly of fibres downstream from said second twisting device, enclosure means to enclose the travelling assembly of fibres passing between the second and third twisting device in its direction of travel, and steam injection means to inject steam into the enclosure; said third twisting device comprising a third rotary structure rotatable about a third rotational axis, a third plurality of pulleys mounted on the third rotary structure in an array disposed about the third rotational axis with each pulley in the third array rotatably mounted on the third rotary structure for rotation about an individual axis of pulley rotation which is generally parallel to said third rotational axis and moves around said rotational axis on rotation of the third rotary structure, third input guide means to guide the travelling assembly entering the third twisting device into a path in which it will successively engage the pulleys of the third array, and third exit guide means to guide the travelling assembly from that path into an axis path from the third twisting device; and third drive means to rotate said third rotary structure about the third rotational axis and also to rotate the pulleys of said third array about their respective pulley axis.

6. Apparatus as claimed in claim 5, wherein the third drive means is operable to drive said third rotary structure at the same rotational speed as said second rotational structure and to drive the pulleys of said third array at the same peripheral speed as the pulleys of said second array.

7. Apparatus as claimed in claim 6, further comprising assembly guide means to guide the travelling assembly within said enclosure through successive reversals of direction whereby to increase the residence time of the travelling assembly with the enclosure.

8. Apparatus as claimed in claim 7, wherein said assembly guide means comprises a first accumulator pulley means disposed within the enclosure and rotatably coupled to said second rotary structure, a second accumulator pulley means disposed within the enclosure and rotatably coupled to the third rotary structure whereby to guide the travelling assembly back and forth between the first and second accumulator pulley means in successive passes within the enclosure.

9. Apparatus as claimed in claim 8, wherein the first accumulator pulley means comprises a pair of accumulator pulleys.

10. Apparatus as claimed in claim 8, wherein the second accumulation pulley means comprises a pair of accumulation pulleys.

* * * * *

UNITED STATES PATENT AND TRADEMARK OFFICE

CERTIFICATE OF CORRECTION

PATENT NO. :5,758,483

DATED : June 2, 1998

INVENTOR(S) : David G. Phillips, et al.

It is certified that error appears in the above-identified patent and that said Letters Patent is hereby corrected as shown below:

On the title page, item [22]

Please delete the filing date of PCT/AU94/00544 "September 13, 1994" and insert --September 15, 1994.--

Signed and Sealed this

Twenty-fourth Day of August, 1999

*Attest:*

Q. TODD DICKINSON

*Attesting Officer*

*Acting Commissioner of Patents and Trademarks*